US007504617B2

(12) United States Patent
Peters et al.

(10) Patent No.: US 7,504,617 B2
(45) Date of Patent: Mar. 17, 2009

(54) DEVICE FOR DETECTING A THREAD DURING THE DETECTION OF THREAD ENDS IN A SUCTION PIPE

(75) Inventors: Erwin Peters, Düren (DE); Thomas Wegmann, Heinsberg (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 400 days.

(21) Appl. No.: 10/585,800

(22) PCT Filed: Dec. 29, 2004

(86) PCT No.: PCT/EP2004/014785

§ 371 (c)(1),
(2), (4) Date: Jul. 13, 2006

(87) PCT Pub. No.: WO2005/070800

PCT Pub. Date: Aug. 4, 2005

(65) Prior Publication Data

US 2008/0217462 A1 Sep. 11, 2008

(30) Foreign Application Priority Data

Jan. 22, 2004 (DE) ..... 10 2004 003 174

(51) Int. Cl.
*H01J 40/14* (2006.01)

(52) U.S. Cl. ..... 250/221; 250/559.4

(58) Field of Classification Search ..... 250/221, 250/559.4, 559.28; 356/73, 237.1, 238.2, 356/241.1; 209/534
See application file for complete search history.

(56) References Cited

U.S. PATENT DOCUMENTS

| | | | | |
|---|---|---|---|---|
| 3,203,634 | A | 8/1965 | Fürst | 242/18 |
| 3,728,550 | A | 4/1973 | Cleland, Jr. et al. | 250/219 |
| 6,422,072 | B1 * | 7/2002 | Emch et al. | 73/160 |

FOREIGN PATENT DOCUMENTS

| | | |
|---|---|---|
| DE | 1 276 523 | 8/1968 |
| DE | 2 163210 | 4/1973 |
| DE | 25 31 044 | 1/1977 |
| DE | 43 08 058 A1 | 9/1994 |

* cited by examiner

*Primary Examiner*—Que T Le
(74) *Attorney, Agent, or Firm*—K&L Gates, LLP

(57) ABSTRACT

The device detects a thread during the detection of the ends of threads (21) in suction pipe (17) crossflown by air, comprising a sensor device (22) having a transmitter (31) and a receiver (32) in a textile machine producing cross-wound bobbins. A measuring field (26) is formed between the transmitter (31) and the receiver (32). The suction pipe has a curvature in the area of the measuring field (26). The measuring field (26) is arranged in proximity of the smaller radius of the suction pipe (17), which has a recess (27) oriented in the running direction of the suction pipe (17) to form the measuring field (26). The suction pipe (17) is curved upstream and downstream of the measuring field (26) such that the detected thread is tensed inside the recess (27) to be spaced at least partly from the bottom of the recess (27) in the measuring field (26), making it possible to easily and reliably detect the thread.

6 Claims, 3 Drawing Sheets

DEVICE FOR DETECTING A THREAD DURING THE DETECTION OF THREAD ENDS IN A SUCTION PIPE

CROSS-REFERENCES TO RELATED APPLICATIONS

This application claims the benefit of German patent application 10 2004 003 174.6, filed Jan. 22, 2004, herein incorporated by reference.

BACKGROUND OF THE INVENTION

The invention relates to a device for detecting a thread during the detection of thread ends in a suction pipe through which air flows, with a sensor mechanism comprising a transmitter and a receiver for detecting a thread with the features of the preamble of claim 1.

Suction pipes of this type are equipped, for example, with devices for detecting a thread, in order to ascertain the detection of the thread end on the take-up bobbin side or the supply bobbin side, which thread end is to be supplied to a thread connecting mechanism on a winding head. Suction pipes are also equipped with a device of the type, which are used on cop preparation mechanisms, in order to ascertain whether it was possible to detect the thread, which is then to be provided at a suitable location for later detection in the winding head. As a function of this test result, further steps are then introduced depending on the type of preparation mechanism.

A device for detecting a thread in a channel through which air flows is known from German Patent Publication DE 25 31 044 A1. The channel is a component of a suction mechanism for detecting the thread on the take-up bobbin side on a winding head. Opposing openings, which are flush with one another are present on a pipe bend in the pipe wall for receiving a sensor arrangement formed from a radiation source and a receiver. This sensor arrangement forms a light barrier crossing the channel, the interruption of which by the thread can be detected. The optical systems facing one another in the form of lenses become soiled as a function of the loading of the thread with impurities after a certain period of use, whereby the reliability of the measuring reduces. This soiling is even heavier than at other channel parts owing to the air guidance at a pipe bend.

German Patent Publication DE 21 63 210 A1 discloses a device for drawing off a certain yarn length from a yarn supply. In a pipe, the presence of a thread is detected by means of a light source and a photocell. Owing to the arrangement of the light source and photocell at a pipe bend, the spacing between the light source and photocell is significantly greater than the diameter of the tube. The position of the light source in an angle range of the pipe with a weaker air flow encourages rapid soiling of the light source. Both the large spacing and the soiling bring about a weakening of the signals of the sensor mechanism. The detection of the thread is hindered thereby and even completely prevented.

A pneumatic device for searching for and drawing off a thread beginning of a textile bobbin is known from German Patent Publication DE 12 76 523 B, in which the thread is aspirated by means of a suction pipe. The pipe has a longitudinal slot, through which the thread is guided in a zone outside the pipe. In this zone, a measuring device is arranged. The measuring device determines the presence of the thread. In the zone outside the pipe, dirt, in particular softeners, short fibers or abraded thread parts caused at the deflection edge at the beginning of the slot are released by the thread. The measuring device becomes soiled and is subjected to functional disturbances or functional failures. Secondary air is aspirated into the pipe through the slot. Performance losses to the suction occur as a result. The air flow is disturbed and weakened.

The generic German Patent Publication DE 43 08 058 A1 describes a device in particular for use on cop preparation mechanisms or feeders to a thread connecting mechanism, wherein the channel cross-section is monitored with the aid of a sensor device. The transmitter and receiver of the sensor arrangement are arranged outside openings of a channel, which are flush with one another. An air gap is present in each case between the outlet of the openings and the radiation source or the receiver. Owing to the sensors located outside, contact with the thread or with the suction air flow surrounding it in the channel is avoided. Dirt entrained by the thread, in particular softener, no longer reaches the sensors, but the openings through the wall of the suction channel and the edges connected thereto, can lead to disruptions of the air flow in the suction channel and entail the formation of accumulations of dirt, for example the formation of piles of lint.

Secondary air is drawn into the suction channel through the openings, and this leads to a loss of performance of the suction device.

The spacing between the transmitter and receiver is at least as large as the diameter of the channel. This makes a more costly sensor mechanism necessary if reductions are not to be accepted in the thread detection.

SUMMARY OF THE INVENTION

The object of the invention is to improve the generic device of German Patent Publication DE 43 08 058 A1.

The object is achieved according to the invention with a device for detecting a thread during the detection of thread ends in a suction pipe through which air flows, with a sensor mechanism comprising a transmitter and a receiver, wherein a measuring field is formed between the transmitter and receiver and the suction pipe has a curvature in the region of the measuring field. According to the invention, the measuring field is arranged at least in the proximity of the smaller radius of the suction pipe, in that a recess oriented in the running direction of the suction pipe is present to form the measuring field, in that upstream and downstream from the measuring field, the suction pipe is curved in such a way that the detected thread is tensed inside the recess in such a way that it is spaced at least partly from the bottom of the recess, in the measuring field.

In the device according to the invention, the thread is guided in such a way that it moves in the measuring field at a spacing from the wall of the suction pipe and can be positioned well in the measuring field. Owing to its "fluttering movement" transverse to its running direction, the thread can be detected particularly easily and reliably. The transmitter and receiver are arranged in such a way that the recess runs between them. It is therefore possible to produce a spacing between the transmitter and receiver which is significantly smaller than the diameter of the suction pipe. The transmitter and receiver can therefore be used in a simple, more economic design with a reliable detection of the thread remaining ensured.

If at least the beginning of the recess is located in the region of the curvature of the suction pipe, if the wall of the suction pipe forms the guide of the detected thread at the beginning and end of the recess and if the thread course of the detected thread determined by the guide is always located inside the suction pipe, the thread being tensed inside the recess and the thread course crossing the measuring field inside the recess and at least being partly spaced apart from the bottom of the recess, a spacing between the thread and the bottom of the suction pipe inside the measuring field placed in the region of the recess can easily be achieved. Even if it is possible in the scope of the invention that the measuring field runs between the transmitter and receiver through holes which are flush with one another, which penetrate the wall of the suction pipe, it is advantageous to configure the suction pipe in the region of the sensor mechanism in such a way that no disturbances take place owing to openings in the wall of the suction pipe at which deposits could also form. The suction pipe is transparent for this purpose. An economical design of a transparent suction pipe is made possible by the use of polypropylene as the transparent material.

Owing to a configuration of the suction pipe with the recess beginning so gradually in the flow direction that the air flow is not, or only insubstantially, disturbed, disturbances of the air flow can also be minimized or avoided.

If the recess is narrow, not only can a small spacing between the transmitter and receiver be adjusted, but the wall of the suction pipe is cleared by the movement of the thread and the depositing of dirt is counteracted.

BRIEF DESCRIPTION OF THE DRAWINGS

Further details of the invention can be inferred from the figures, in which.

DETAILED DESCRIPTION OF THE PREFERRED EMBODIMENTS

Figure 1:
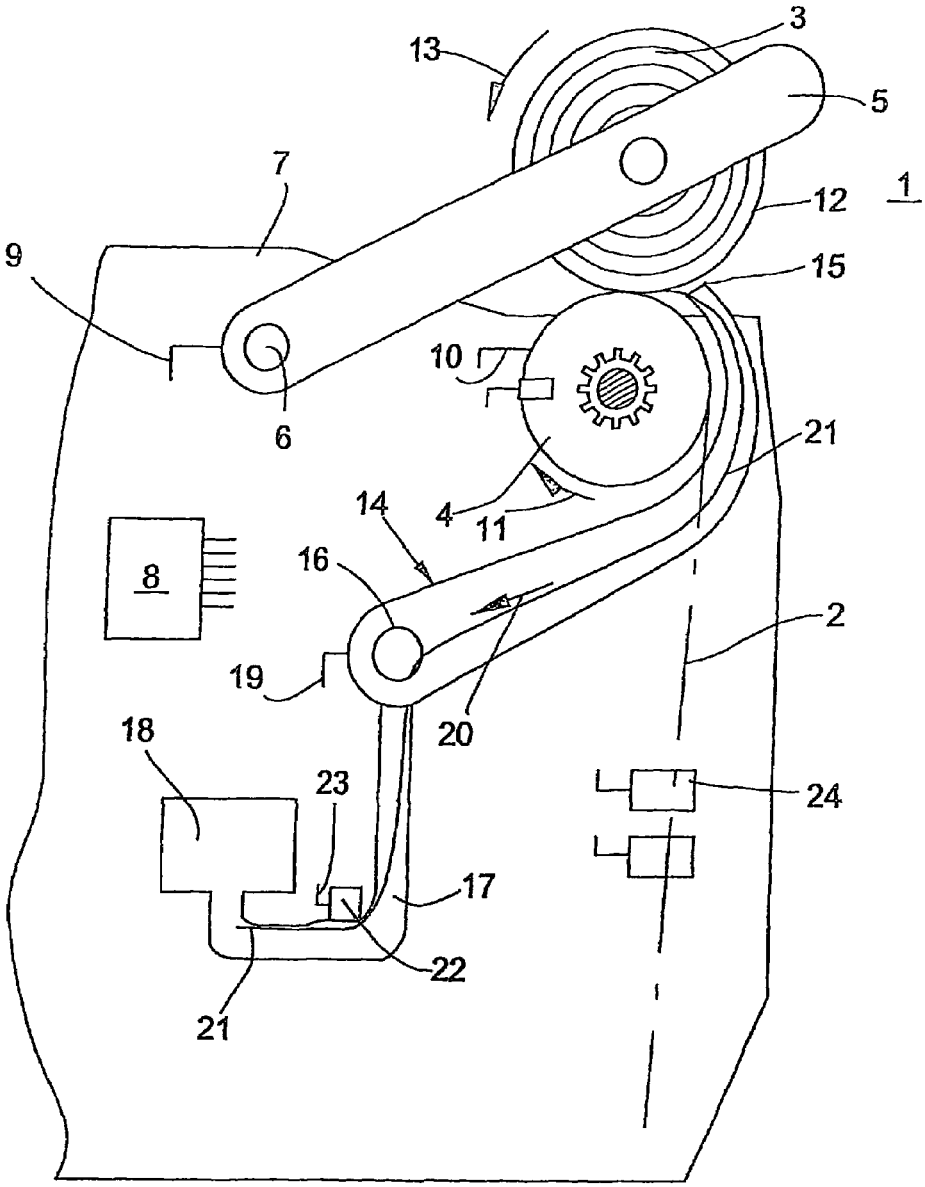
FIG. 1 shows a simplified view of a winding head with a suction nozzle positioned in front of the take-up bobbin.

FIG. 1 shows a winding head of a textile machine producing cross-wound bobbins. FIG. 1 shows a situation at the winding head 1, in which the thread run has been interrupted after a thread cut owing to a yarn defect and measures to remove the yarn defect, a so-called clearing, have been introduced. The thread run during operation of the winding head 1 is identified by the dashed line 2. During operation of the winding head 1, the thread is drawn off from a thread source, not shown. The thread source can be a supply bobbin or a spinning device.

The thread is wound onto a cross-wound bobbin 3 acting as a take-up bobbin. For clearing, the defective thread piece, which has been taken onto the cross-wound bobbin 3, has to be so completely unwound therefrom, that when the thread is cut, the yarn defect is located in the cut-off thread part. The cross-wound bobbin 3, in the view of FIG. 1, has already been lowered again onto the winding roller 4. The cross-wound bobbin 3 is held by a bobbin holder 5, which is mounted in a rotary joint 6 in the machine frame 7, which is only indicated here. The actuation of the drive, not shown here, of the bobbin holder 5 is controlled by the control mechanism 8 via the line 9. The winding roller 4 is driven by a drive, not shown here, which is also connected to the control mechanism 8 via the line 10. In order to unwind the defective thread piece, the winding roller 4 is driven counter to the winding direction, in accordance with the arrow 11 and drives the cross-wound bobbin 3, supported by its peripheral face 12, in the unwinding direction 13.

A suction nozzle 14 with its mouth 15 has been positioned in front of the peripheral face 12 of the cross-wound bobbin 3. The suction nozzle 14 is mounted in the rotary joint 16 in the machine frame 7, the connection to the central suction channel 18 of the vacuum supply of the textile machine taking place in the rotary joint 16 via a suction pipe 17. The pivoting movement of the suction nozzle 14 takes place by means of a drive, not shown here, which is connected to the control mechanism 8 via a line 19. A valve, not shown here, is also activated by the control mechanism 8, so the suction pipe 17 is loaded by the suction channel 18 with a vacuum. Owing to the air flow applied at the mouth 15 of the suction nozzle 14 shown in section in FIG. 1, the direction of which is indicated by the arrow 20, the thread end 21 located on the peripheral face 12 of the cross-wound bobbin 3 is sucked into the suction nozzle 14.

In the view of FIG. 1, the thread end 21 has reached a sensor mechanism 22 arranged in the suction pipe 17. The presence of the thread end 21 in the suction pipe 17 is detected by the sensor mechanism 22 and signalled via the line 23 to the control mechanism 8. When the thread end 21 has reached the sensor mechanism 22, a check is made as to whether the thread end 21 has already been unwound at this time from the take-up bobbin to such an extent that the defect ascertained by the clearer 24 has already been unwound again from the cross-wound bobbin 3. If this is so, the unwinding and aspiration of the thread end 21 is stopped. The thread end 21 is held by the vacuum in the suction nozzle 14. When the suction nozzle 14 is pivoted down, the cross-wound bobbin 3 carries out a certain rotation in the direction of the arrow 13, by means of which a length of the wound-on thread is unwound again from the cross-wound bobbin 3 such that the thread end 21 can retain its position in the suction nozzle 14. Further descriptions with regard to winding heads of this type can be inferred, for example from DE 196 40 184 A1 or its parallel application U.S. Pat. No. 5,862,660.

Figure 2:
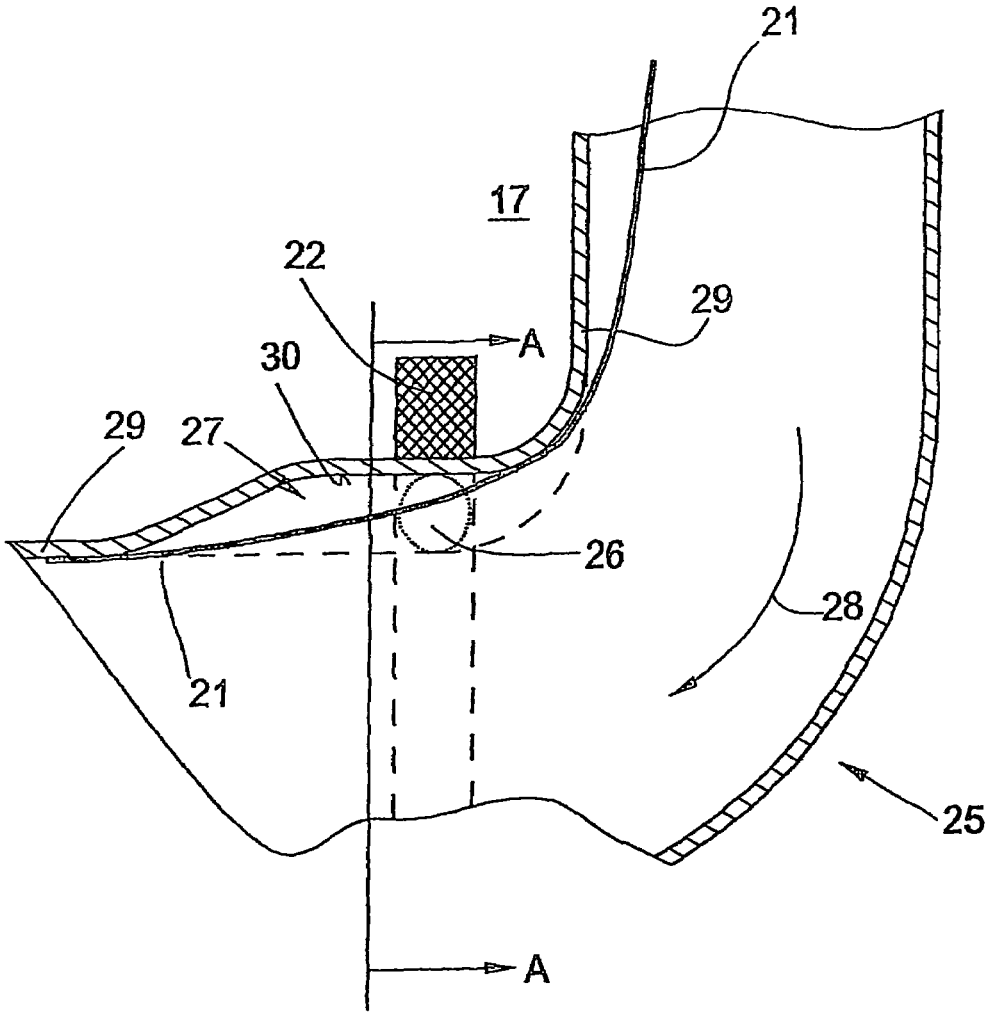
FIG. 2 shows a section through a suction pipe through which air flows in the region of a suction pipe curvature with a sensor mechanism and recess.

FIG. 2 shows a curvature 25 of the suction pipe 17 with the sensor mechanism 22. The measuring field 26 of the sensor mechanism 22 is arranged in the proximity of the smaller radius of the curvature 25 of the suction pipe 17. The suction pipe 17 has a recess 27 oriented in the running direction. The thread end 21 is detected by the air flow flowing in the direction of the arrow 28 and tensed in the region of the recess 27.

The thread end 21 rests here on the part of the wall 29 of the suction pipe 17 positioned toward the smaller radius, while it is spaced from the bottom 30 of the recess 27 in the tensed state. The recess 27 begins in the flow direction very gradually in the course of the curvature 25, so the air flow is not, or only insubstantially, disturbed. In the region of the recess 27, the thread end 21 can be made to oscillate by the air flow. Owing to a "fluttering movement" of this type, the thread end can be detected reliably and easily, the sensor device being configured as a movement detector.

Figure 3:
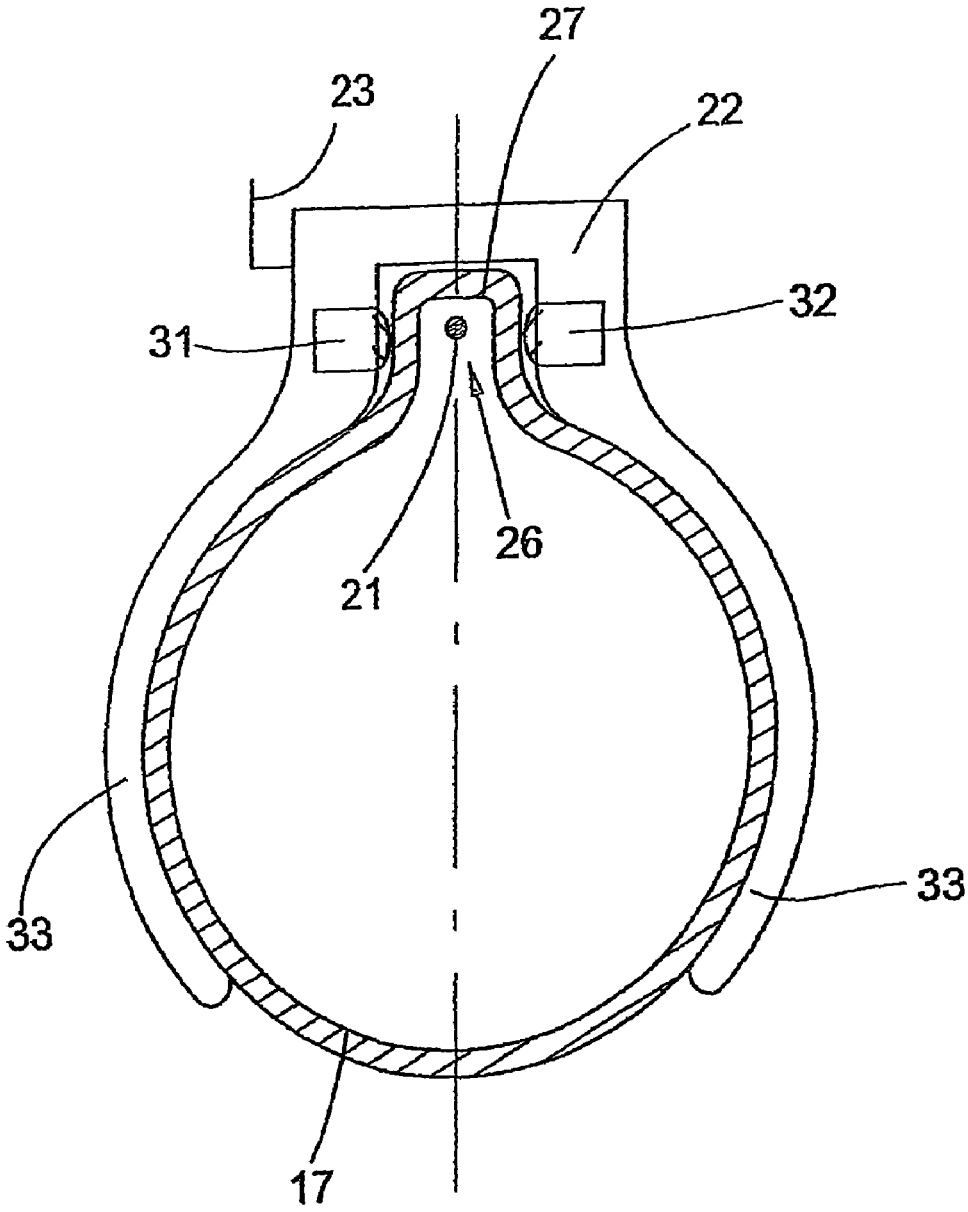
FIG. 3 shows a cross-section A-A through the suction pipe of FIG. 2.

FIG. 3 shows the suction pipe 17 and the sensor mechanism 22 in the view A-A of FIG. 2. In the suction pipe 17, the recess 27 is narrow. The sensor mechanism 22 has a transmitter 31 and a receiver 32 and two holding arms 33. The transmitter 31 is configured as a light source and the receiver 32 as a photosensor. The holding arms 33 are configured at least partially elastically. A design of this type of the sensor mechanism 22 can be positioned quickly by simple mounting on the suction pipe 17.

The sensor mechanism 22 is positioned in the view of FIG. 3 in such a way that the recess 27 in the measuring field 26 is located between the transmitter 31 and receiver 32. The thread end 21 runs in the recess 27. The spacing between the transmitter 31 and receiver 32 is substantially smaller than the diameter of the suction pipe 17. The proximity of the transmitter 31 and receiver 32 constantly ensures reliable detection of the thread end. In the recess 27, the air flow can move the thread end 21 transversely to the running direction. An alternative embodiment of the sensor mechanism 22 uses this movement, in which the sensor mechanism 22 is configured as a movement detector.

As the recess 27 is narrow, the thread end 21 can touch the side walls of the recess 27 by its movements transverse to the running direction or come so close to them that a clearing of the surface of the suction pipe 17 takes place in this region. A soiling of the surface in the measuring field 26 is counteracted thereby.

The suction pipe 17 can be configured, for example, in such a way that it has an external diameter of 50 mm and a wall thickness of 2 mm, with it being possible to configure the spacing between the side walls of the recess 27 at 6 mm. The suction pipe 17 according to the invention can be produced particularly economically from transparent polypropylene.

The suction pipe 17 can also be configured in such a way that the cross-section of the suction pipe 17 in the pipe section, which has the recess 27, is kept substantially the same compared to the pipe sections with a circular cross-section. If a location with a smaller, or the narrowest cross-section is located downstream from the measuring field 26 in the suction pipe 17 in the course of the air flow, the thread end 21 in the measuring field 26 is loaded particularly well with thread tension.

The recess 27 may already begin a long way upstream from the measuring field 26 in the suction pipe 17 and end a long way downstream from the measuring field 26, in order to facilitate a quite gradual change of the cross-sectional shape of the suction pipe 17. In a gradual change of the cross-sectional shape, the air flow is not, or hardly, disturbed.

The detection of the thread end 21 is improved by means of the device according to the invention. This contributes to higher productivity of the textile machine, since the faster and more reliably the detection of the thread end 21 can take place, the sooner the phases of the process following, for example, for a spinning starting process, can be initiated and the lower is the danger of having to repeat the entire spinning starting process, because the thread end 21 has not, or has only been inadequately detected by the suction nozzle 14.

The term "thread end" comprises the section of the thread drawn off again from the cross-wound bobbin 3.

The invention claimed is:

1. Device for detecting a thread during the detection of thread ends in a suction pipe through which air flows, with a sensor mechanism comprising a transmitter and a receiver, wherein a measuring field is formed between the transmitter and receiver and the suction pipe has a curvature in the region of the measuring field, characterized in that the suction pipe (17) has an elongate recess (27) on the smaller radius of curvature, which recess is oriented in the running direction of the suction pipe (17), in that the recess (27) is outwardly curved in the wall of the suction pipe (17) and is channel-shaped, in that the transmitter and the receiver are each arranged at opposing side walls of the recess (27), in that at least the beginning of the recess (27) is located in the region of the curvature of the suction pipe (17), in that the wall of the suction pipe (17) forms the guide of the detected thread at the beginning and end of the recess (27) and the thread course of the detected thread oriented by the guide is always located inside the suction pipe (17), in that the thread is tensed inside the recess (27) and the thread course inside the recess (27) crosses the measuring field (26) and is at least partly spaced apart from the bottom (30) of the recess (27).

2. Device according to claim 1, characterized in that the side walls of the recess (27) run at least virtually parallel to one another in the region of the measuring field (26).

3. Device according to claim 1, characterized in that the wall of the suction pipe (17) is closed and transparent.

4. Device according to claim 3, characterized in that polypropylene is used as the transparent material.

5. Device according to claim 1, characterized in that the recess (27) is configured such that the transition in the flow direction between the beginning of the recess (27) and reaching the full depth of the recess (27), takes place so gradually that the air flow is not, or only insubstantially, disturbed.

6. Device according to claim 1, characterized in that the recess (27) is so narrow that the movement of the thread brings about a clearing of the wall of the suction pipe (17) in the measuring field (26).

* * * * *